US008723596B2

(12) United States Patent
Chi et al.

(10) Patent No.: US 8,723,596 B2
(45) Date of Patent: May 13, 2014

(54) REGULATION DEVICE AND POWER ADAPTER USING THE SAME

(75) Inventors: Der-Ho Chi, New Taipei (TW); Mi Tang, Shenzhen (CN); Chun-Peng Huang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 299 days.

(21) Appl. No.: 13/097,024

(22) Filed: Apr. 28, 2011

(65) Prior Publication Data

US 2012/0161743 A1 Jun. 28, 2012

(30) Foreign Application Priority Data

Dec. 24, 2010 (CN) ..... 2010 1 0604384

(51) Int. Cl.

| | |
|---|---|
| ***G05F 1/00*** | (2006.01) |
| ***G05F 3/16*** | (2006.01) |
| ***G05F 3/20*** | (2006.01) |
| ***G05F 1/10*** | (2006.01) |
| ***G05F 3/02*** | (2006.01) |

(52) U.S. Cl.

USPC ..... 327/540; 323/281; 323/313; 323/314

(58) Field of Classification Search

USPC ..... 323/265, 281, 303, 313, 314, 352; 327/540

See application file for complete search history.

(56) References Cited

U.S. PATENT DOCUMENTS

| | | | | |
|---|---|---|---|---|
| 4,264,785 | A * | 4/1981 | Jacobson | 379/78 |
| 5,038,266 | A * | 8/1991 | Callen et al. | 363/89 |
| 2001/0026186 | A1 * | 10/2001 | Watanabe et al. | 327/530 |
| 2004/0032293 | A1 * | 2/2004 | Maigret et al. | 327/540 |

* cited by examiner

*Primary Examiner* — Adolf Berhane
*Assistant Examiner* — Gary Nash
(74) *Attorney, Agent, or Firm* — Novak Druce Connolly Bove + Quigg LLP

(57) ABSTRACT

A power adapter includes a regulation device, which includes a division circuit, a reference circuit, and an impedance regulation circuit. The division circuit includes a first reference terminal and a second reference terminal. The second reference terminal is connected to an output terminal of the regulation device. The reference circuit includes a third reference terminal connected to the first reference terminal, and the reference circuit outputs a stable reference voltage via the third reference terminal, to provide the stable reference voltage for the first reference terminal. The impedance regulation circuit is connected to the first reference terminal, to provide equivalent impedance for the first reference terminal. The impedance of the equivalent impedance changes in a way corresponding to changes in the current flowing through the output terminal.

14 Claims, 2 Drawing Sheets

REGULATION DEVICE AND POWER ADAPTER USING THE SAME

BACKGROUND

1. Technical Field

The present disclosure relates to regulation devices and, particularly, to a regulation device which can compensate for voltage loss in a cable and a power adapter using the same.

2. Description of Related Art

Power adapters usually connect to an electronic device via a cable, to provide a rated voltage for the electronic device. However, because internal resistance of the cable will generate voltage loss, the actual voltage the electronic device receives may be lower than its rated voltage, which may affect stability and service life of the electronic device.

Therefore, a power adapter with a regulation device which can compensate for voltage loss in a cable is needed.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
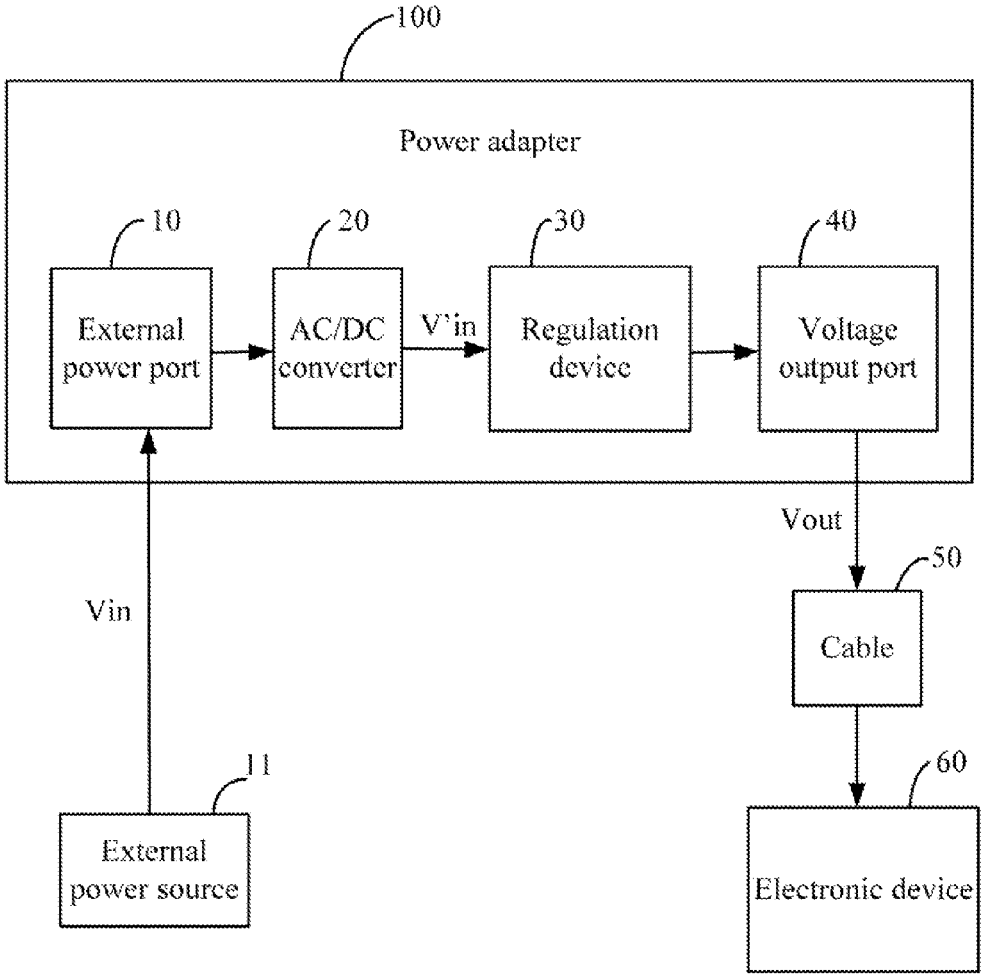
FIG. 1 is a block diagram of a power adapter, which includes a regulation device, according to an embodiment.

Referring to FIG. 1, a power adapter 100 includes an external power port 10, an alternating current and direct current (AC/DC) converter 20, a regulation device 30, and a voltage output port 40. The external power port 10 is configured for connecting to an external power source 11, to receive an AC voltage Vin. The AC voltage Vin is provided to the AC/DC converter 20 to be converted to a DC voltage V'in, which is then provided to the regulation device 30. The regulation device 30 regulates the DC voltage to an appropriate value, and then outputs it to an electronic device 60 via the voltage output port 40 and a cable 50.

Figure 2:
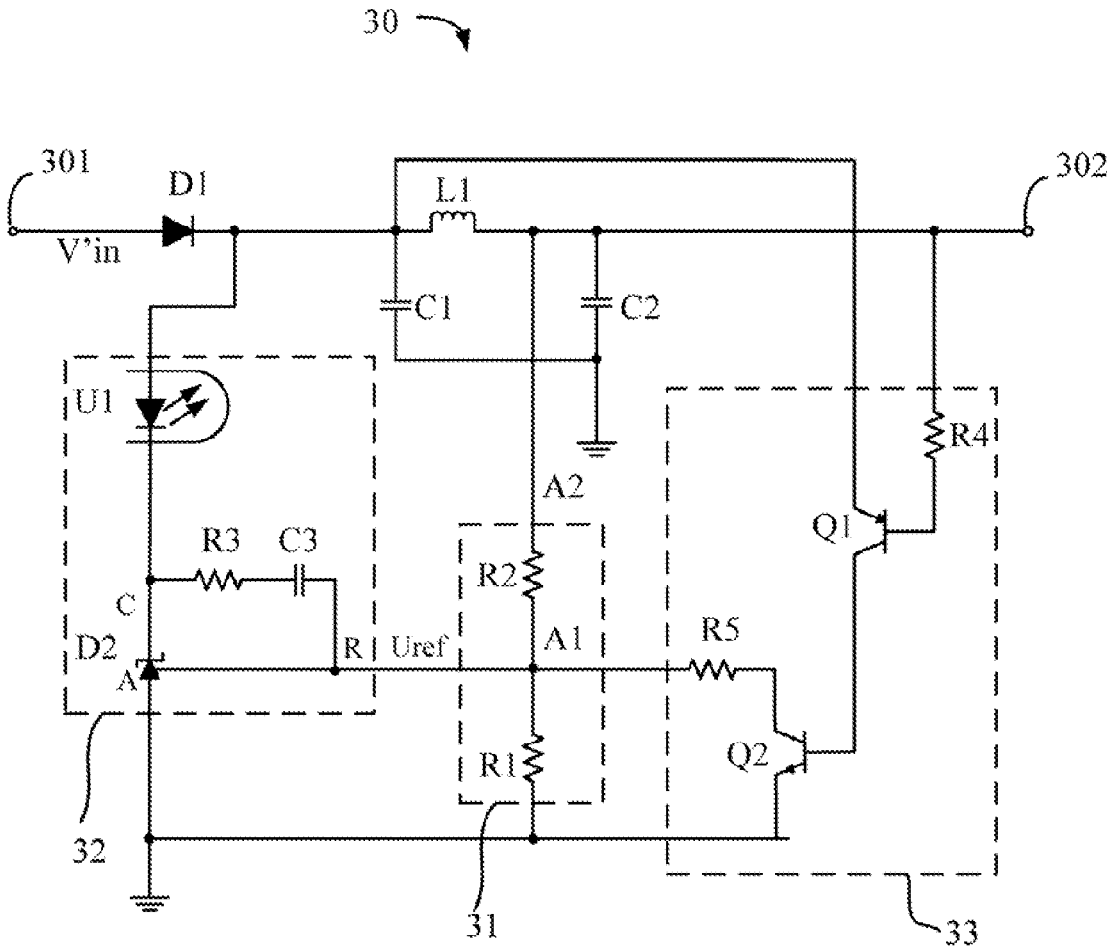
FIG. 2 is an exemplary circuit diagram of the regulation device of FIG. 1.

Referring also to FIG. 2, in the embodiment, the regulation device 30 includes a division circuit 31, a reference circuit 32, and an impedance regulation circuit 33. The division circuit 31 includes a first reference terminal A1 and a second reference terminal A2, and the second reference terminal A2 is connected to an output terminal 302 of the regulation device 30. The reference circuit 32 includes a third reference terminal R connected to the first reference terminal A1. The reference circuit 32 outputs a stable reference voltage Uref via the third reference terminal R, to provide the stable reference voltage for the first reference terminal A1. The impedance regulation circuit 33 is connected to the output terminal 302 of the regulation device 30 and the first reference terminal A1, to provide equivalent impedance for the first reference terminal A1. In the embodiment, the impedance of the equivalent impedance changes in a way corresponding to changes in the current flowing through the output terminal 302.

Specifically, the division circuit 31 includes a first resistor R1 and a second resistor R2 connected in series. The connection node between the first resistor R1 and the second resistor R2 forms the first reference terminal A1. A terminal of the first resistor R1 far from the first reference terminal A1 is grounded. A terminal of the second resistor R2 far from the first reference terminal A1 forms the second reference terminal A2. The second reference terminal A2 is also connected to a voltage input terminal 301 of the regulation device 30 via an inductor L1 and a diode D1. In the embodiment, the voltage input terminal 301 receives the voltage V'in output from the AC/DC converter 20.

The reference circuit 32 includes a voltage stabilizer D2 and an optical coupler U1. The anode A of the voltage stabilizer D2 is grounded, and the cathode C is connected to the voltage input terminal 301 of the regulation device 30 via the optical coupler U1 and the diode D1. The voltage stabilizer D2 also includes a terminal R forming the third reference terminal R, which is connected to the cathode C via a capacitance C3 and a resistor R3. The voltage stabilizer D2 obtains a voltage from the voltage input terminal 301 via the optical coupler U1, and outputs the reference voltage Uref at the third reference terminal R.

The impedance regulation circuit 33 includes a first switch Q1 and a second switch Q2. The first switch Q1 and the second switch Q2 each include a control terminal, a first path terminal, and a second path terminal. In the embodiment, when a voltage difference between the control terminal and the first path terminal of the first switch Q1 or the second switch Q2 is equal to or higher than a predetermined value, the first switch Q1 or the second switch Q2 is switched on. When different voltage difference exists between the control terminal and the first path terminal, the first switch Q1 or the second switch Q2 is switched on at different conduction levels and has different internal resistances.

In the embodiment, the first switch Q1 is a pnp bipolar junction transistors (BJT), and the second switch Q2 is an npn BJT. The bases, emitters, and collectors of the pnp BJT and the npn BJT constitute the control terminals, the first path terminals, and the second path terminals of the first switch Q1 and the second switch Q2 correspondingly. The greater the conduction level of the pnp BJT and the npn BJT, the smaller internal resistance will be. In the embodiment, the base of the pnp BJT Q1 connects to the output terminal 302 of the regulation device 30 via a resistor R4, the emitter connects to the output terminal 302 via the inductor L1, and the collector connects to the base of the npn BJT Q2. The emitter of the npn BJT Q2 is grounded, and the collector connects to the first voltage reference terminal A1 of the division circuit 31 via a resistor R5.

In the embodiment, the first resistor R1 and the second resistor R2 both have large resistance. In use, when the output terminal 302 is not connected to any electronic device, the current flowing through a conductive path formed by the inductor L1, the second resistor R2, and the first resistor R1, is small. A voltage drop across the inductor L1 is approximately zero, and there is no voltage drop across the resistor R4, thereby the pnp BJT Q1 is switched off. In the meantime, as there is no current flowing through the base of the npn BJT Q2, the npn BJT is also switched off. Thereby, the regulation device 30 outputs a stable voltage Uout at the output terminal 302 via the voltage stabilizer D2, the first resistor R1, and the second resistor R2, and the voltage Uout=(R1+R2)*Uref/R1, which is preset to be equal to the rated voltage of the electronic device 60 to be connected to the power adapter 100.

When the electronic device 60 connects to the output terminal 302 via the cable 50, the output terminal 302, the cable 50 and the electronic device 60 form a conductive path, and there is current flowing through the cable 50 and the electronic device 60, with a voltage loss in the cable 50. Thus the actual voltage that the electronic device 60 received is less than its rated voltage Uout.

In the meantime, the voltage drop across the inductor L1 increases as the current flowing through the inductor L1 increases, and the voltage difference between the base and the emitter of the pnp BJT increases, and the pnp BJT Q1 is switched on. Then, there is current flowing through the collector of the pnp BJT Q1 and the base of the npn BJT Q2 to switch on the npn BJT Q2. The total of the resistance of the resistor R5 and an internal resistance Rq2 of the npn BJT Q2 becomes an equivalent parallel resistance of the second resistor R2, thereby reducing the resistance of the first reference terminal A1. Thereby, the voltage U'out=(R2+R1//(R5+Rq2))*Uref/(R1//(R5+Rq2)), is greater than the rated voltage Uout of the electronic device 60, to compensate for the voltage loss in the cable 50, and make the voltage that the electronic device 60 receives equal to its rated voltage.

Furthermore, for the same electronic device 60, the longer the cable 50, the greater the voltage in the cable 50 will be. Thereby, the electronic device 60 can not work normally, and the equivalent impedance of the electronic device 60 decreases, which will increase the current flowing through the output terminal 302 of the regulation device 30.

At this point, the voltage difference between the inductor L1 and the resistor R4 is increased, which will increase the voltage difference between the base and the emitter of the pnp BJT Q1, and further increase the conduction level of the pnp BJT Q1, and increase the voltage at the base of the npn BJT Q2. Thereby the conducting level of npn BJT Q2 is increased to reduce its internal resistance, which will reduce the equivalent parallel impedance of the resistor R2 simultaneously. Thus, the voltage output from the output terminal 302 is increased, to compensate for the voltage loss in the cable 50 regardless of length, and the electronic device 60 can still work normally.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A regulation device comprising:

a division circuit connected between an output terminal of the regulation device and a ground terminal, the division circuit comprising a first resistor and a second resistor connected in series, wherein a first reference terminal is formed between the first resistor and the second resistor;

a reference circuit comprising a second reference terminal connected to the first reference terminal, wherein the reference circuit outputs a stable reference voltage via the second reference terminal, to provide the stable reference voltage for the first reference terminal; and an impedance regulation circuit connected to the output terminal of the regulation device, and also connected between the first reference terminal and the ground terminal, to provide equivalent impedance for the first reference terminal, wherein the impendence of the equivalent impedance changes in a way corresponding to the changes in the current flowing through the output terminal.

2. The regulation device as described in claim 1, wherein the reference circuit comprises a voltage stabilizer, which comprises a terminal forming the second reference terminal, the voltage stabilizer outputs the reference voltage at the second reference terminal.

3. The regulation device as described in claim 1, wherein the impedance regulation circuit comprises a first switch and a second switch, and the first switch and the second switch each comprise a control terminal, a first path terminal, and a second path terminal, the control terminal of the first switch connects to the output terminal of the regulation device via a third resistor, the first path terminal connects to the output terminal via an inductor, and the second path terminal connects to the control terminal of the second switch; the first path terminal of the second switch is grounded, and the second path terminal connects to the first voltage reference terminal of the division circuit via a fourth resistor, when the second switch is switched on, the total of the resistance of the fourth resistor and a internal resistance of the second switch becomes an equivalent parallel resistance of the second resistor.

4. The regulation device as described in claim 3, wherein when a voltage difference generated between the control terminal and the first path terminal of the first switch or the second switch is equal to or higher than a predetermined value, the first switch or the second switch is switched on.

5. The regulation device as described in claim 4, wherein when different voltage difference exists between the control terminal and the first path terminal, the first switch or the second switch is switched on at different conduction levels and has different internal resistances.

6. The regulation device as described in claim 4, wherein the first switch is a pnp BJT, and the second switch is an npn BJT, the bases, emitters, and collectors of the pnp BJT and the npn BJT constitute the control terminals, the first path terminals, and the second path terminals of the first switch and the second switch correspondingly.

7. The power adapter as described in claim 6, wherein the greater the conduction level of the pnp BJT and the npn BJT, the smaller internal resistance is.

8. A power adapter comprising:

an external power port to connect to an external power source, to receive an AC voltage;

an AC/DC converter to convert the AC voltage into a DC voltage; and a regulation device to regulate the DC voltage to an appropriate value, and then output it to an electronic device via a cable, the regulation device comprising:

a division circuit connected between an output terminal of the regulation device and a ground terminal, the division circuit comprising a first resistor and a second resistor connected in series, wherein a first reference terminal is formed between the first resistor and the second resistor;

a reference circuit comprising a second reference terminal connected to the first reference terminal, wherein the reference circuit outputs a stable reference voltage via the second reference terminal, to provide the stable reference voltage for the first reference terminal; and an impedance regulation circuit connected to the output terminal of the regulation device, and also connected between the first reference terminal and the ground terminal, to provide equivalent impedance for the first reference terminal, wherein the impendence of the equivalent impedance changes in a way corresponding to changes in the current flowing through the output terminal.

9. The power adapter as described in claim 8, wherein the reference circuit comprises a voltage stabilizer, which comprises a terminal forming the second reference terminal, the voltage stabilizer outputs the reference voltage at the second reference terminal.

10. The power adapter as described in claim 8, wherein the impedance regulation circuit comprises a first switch and a second switch, and the first switch and the second switch each comprise a control terminal, a first path terminal, and a second path terminal, the control terminal of the first switch connects to the output terminal of the regulation device via a third resistor, the first path terminal connects to the output terminal via an inductor, and the second path terminal connects to the control terminal of the second switch; the first path terminal of the second switch is grounded, and the second path terminal connects to the first voltage reference terminal of the division circuit via a fourth resistor, when the second switch is switched on, the total of the resistance of the fourth resistor and a internal resistance of the second switch becomes an equivalent parallel resistance of the second resistor.

11. The power adapter as described in claim 10, wherein when a voltage difference between the control terminal and the first path terminal of the first switch or the second switch is equal to or higher than a predetermined value, the first switch or the second switch is switched on.

12. The power adapter as described in claim 11, wherein when different voltage difference exists between the control terminal and the first path terminal, the first switch or the second switch is switched on at different conduction levels and has different internal resistances.

13. The power adapter as described in claim 11, wherein the first switch is a pnp BJT, and the second switch is an npn BJT, the bases, emitters, and collectors of the pnp BJT and the npn BJT constitute the control terminals, the first path terminals, and the second path terminals of the first switch and the second switch correspondingly.

14. The power adapter as described in claim 13, wherein the greater the conduction level of the pnp BJT and the npn BJT, the smaller internal resistance is.

* * * * *